United States Patent [19]

La Fata, John E. et al.

[11] 4,180,938

[45] Jan. 1, 1980

[54] BUBBLE BLOWING WAND

[76] Inventors: La Fata, John E., 3240 Sunset La., Oxnard, Calif. 93030; John D. Cuccio, 808 N. Signal St., Ojai, Calif. 93023

[21] Appl. No.: 842,664

[22] Filed: Oct. 17, 1977

[51] Int. Cl.[2] ..... A63H 33/28

[52] U.S. Cl. ..... 46/6

[58] Field of Search ..... 46/6-8

[56] References Cited

U.S. PATENT DOCUMENTS

| | | | |
|---|---|---|---|
| 3,109,255 | 11/1963 | Hein | 46/7 |
| 3,818,627 | 6/1974 | Lebensfeld | 46/7 |

FOREIGN PATENT DOCUMENTS

| | | | |
|---|---|---|---|
| 1329796 | 9/1973 | United Kingdom | 46/6 |

*Primary Examiner*—Louis G. Mancene
*Assistant Examiner*—Robert F. Cutting
*Attorney, Agent, or Firm*—George F. Bethel; Patience K. Bethel

[57] ABSTRACT

A bubble blowing wand for use with a bubble blowing liquid comprising two substantially concentric rings for providing a bubble or bubbles formed within a bubble. The concentric rings are substantially in the same planar relationship with respect to each other. The rings can be substituted with any closed geometric form so long as the peripheries are implaced within each other in a substantially spaced concentric relationship. The preferred concentric rings are formed as a larger outside ring and a smaller inner ring. The larger outside ring is attached to a handle at its outer edge, while the inner surface thereof supports a stem to which the inner ring is connected. Both of the rings have relieved or cut surfaces providing a larger surface area on the rings to accommodate greater amounts of bubble blowing liquid. Attendant with the use of the bubble blowing wand is a substantially spill-proof container having an elastomeric top with at least one slit therein that can be widened when an object passes therethrough, or through shaking of the contents. After deformation, it has sufficient elasticity and memory to return it to the general slit configuration, thereby preventing substantial spills but not forming a completely drip-free and liquid obstructing passage.

10 Claims, 13 Drawing Figures

BUBBLE BLOWING WAND

BACKGROUND OF THE INVENTION

1. Field of the Invention

The field of this invention lies within the toy art. More specifically, it lies within the bubble blowing art as it relates to wands, bottles, and containers for blowing a bubble solution, such as a soap solution.

2. The Prior Art

The prior art relates to bubble blowing is replete with various configurations for providing bubbles in singular and plural form, as well as bubbles within a bubble in both plural and singular form. However, the art for blowing bubbles within a bubble has overlooked the physical requirements of creating a bubble or group of bubbles within a bubble. Although the entire art has alluded to creating such phenomena, it has never substantially succeeded.

There are numerous patents that relate to the creation of a bubble within a second bubble. However, in each case the physics of the device that has purportedly performed the foregoing function has not been found to create the necessary configuration for performing the stated function.

This invention overcomes much of the problems of the prior art by directing itself to a number of specific functions provided by the elements and configuration of the invention. The elements and configuration of the invention have been arrived at after substantial testing and evaluation by the inventors over the years. They have been the named patentees of prior art bubble blowing inventions and have striven to perfect the bubble blowing art to the high state of this invention, which is truly a novel and unobvious approach over the prior art.

The foregoing can be evinced specifically by reading the patent literature. In particular, a patent issued to Lyons B. Joel, II on Oct. 31, 1950, bearing U.S. Pat. No. 2,527,935 shows a pair of rings. The two rings, one being smaller than the other, are attached to a handle. The larger ring is attached at the outer end thereof to an upright member forming the handle. A second ring that is substantially concentric to the first or larger ring is connected to the handle in offset relationship by means of an L shaped brace. The second smaller concentric circle or loop is attached to the upper portion of the L shaped brace or member at its outer edge.

The entire disclosure of Joel relates to two respective rings being in displaced relationship from each other and substantially outside of a plane passing through one or the other. Secondly, the disclosure or Joel's rings, although concentrically aligned and oriented in parallel planes, is still laterally offset from one or the other which is a debilitating factor for proper operation.

In addition to the foregoing, Joel has a smooth wire surface. The peripheral surface of the entire portion of Joel 's rings or concentric circles present a smooth, uninterrupted surface, not only in the drawing, but also in the claims. The applicants have found that this also is not the most desirable way to proceed in the blowing of bubbles, as will be expanded upon hereinafter.

Not only have the applicants created an invention which is substantially different from Joel, but also one wherein the preferred embodiments show features beyond that established by the prior art either singularly or in combination. As a consequence, this invention, although simple in appearance, should be considered a substantial step over the prior art due to its superior operative features in blowing bubbles within bubbles, as well as its ease in manufacture and effectiveness in providing the end result desired by the toy industry, in this particular art.

SUMMARY OF THE INVENTION

In summation, this invention comprises a pair of concentric rings having relieved surfaces on a wand within a substantially similar plane for purposes of blowing a bubble or bubbles within a bubble.

More specifically, this invention comprises a larger first circle or ring attached to a handle at the outer portion of said ring. A second or smaller ring is attached internally to the first or larger ring interiorly thereof by a brace member or stem interconnecting the outside of the smaller ring to the inside of the larger ring.

The foregoing rings are sized as to their diameter in a ratio wherein the larger ring is approximately three times the size of the smaller ring. This one to three diameter ratio can vary, depending upon the viscosity and character of the soap solutions being used. In addition to the foregoing, it has been found that the thickness of the inner ring compared to the outer ring can be optimized by being sized approximately in a ratio of one and one half to one.

The foregoing rings are provided with a relieved surface which is cut, formed, or molded into variable surfaces thereof. The relieved surface can provide lands and grooves or crests and troughs, so that the entire surface area is increased on the rings. This allows for a greater loading or increased amounts of bubble blowing solution to be placed therein. The foregoing limits the drawing or stretching of the solution beyond the limits of its surface tension in a substantially greater manner than the prior art. In other words, the bubble solution is able to be stretched further by virtue of a greater amount being blown over a like area.

In addition thereto, the stem or member supporting the inner ring to the inner surface of the outer ring is substantially of a streamlined configuration to prevent the deterioration of the bubble by either turbulence or inordinately angular surfaces that break down the surface tension of the bubble solution.

This invention also incorporates a bubble blowing container or outer cap having an elastomeric top that is slit to allow the rings to be implaced within the container and then withdrawn. This is performed by expanding the slit that then has sufficient memory to contract after withdrawal of the wand with the rings. In this manner, substantial spills are eliminated, while at the same time not preventing the placement of the wand in the bubble solution container.

As will be seen from the following specification, the inventive aspects of the wand herein are of substantial merit and have not been obviated by the prior art as previously discussed.

BRIEF DESCRIPTION OF THE DRAWINGS

The invention will be more clearly understood by reference to the description below taken in conjunction with the accompanying drawings wherein.

DESCRIPTION OF THE PREFERRED EMBODIMENTS

Figures 1, 2:
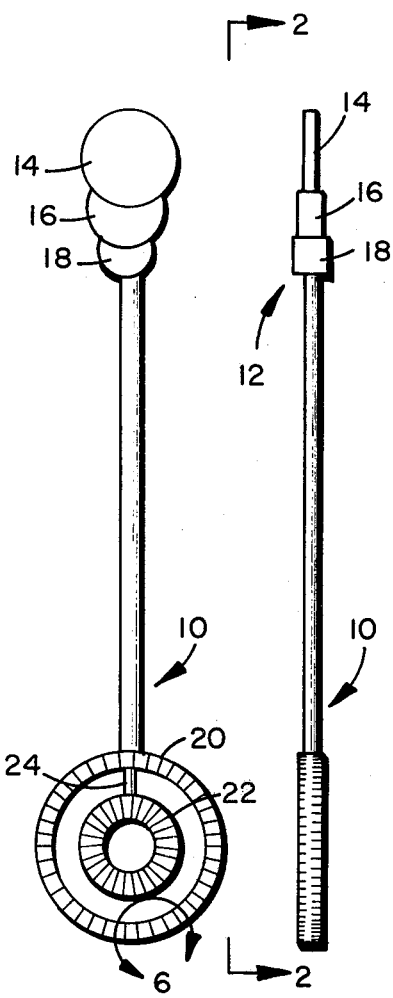
FIG. 1 shows a side elevation view of the bubble blowing wand of this invention.
FIG. 2 shows a front elevation view of the bubble blowing wand of this invention in the direction of lines 2—2 of FIG. 1.
Figure 4:
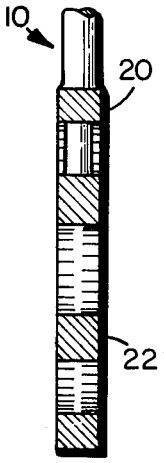
FIG. 4 shows a sectional view of the concentric rings as taken in the direction of lines 4—4 of FIG. 3.

Looking at FIG. 1 and the other figures ancillary thereto, it can be seen that a wand having a handle comprised of an elongated cylindrical member 10 is shown. The handle 10 has a portion at one end thereof for gripping with one's hand. In particular, an end 12 having three discs 14, 16 and 18 in connected relationship has been shown. The discs provide gripping surfaces and have respectively a larger cross sectional thickness as they approach the elongated portion of the handle 10. The handle or elongated cylindrical portion 10 can be formed of any particular cross sectional design such as the cylindrical showing as seen, or a square, rectangular, rhomboidal or curvilinear cross section.

Figure 5:
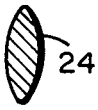
FIG. 5 shows a sectional view of the stem or supporting member between the inner and outer rings in the direction of lines 5—5 of FIG. 3.
Figure 8:
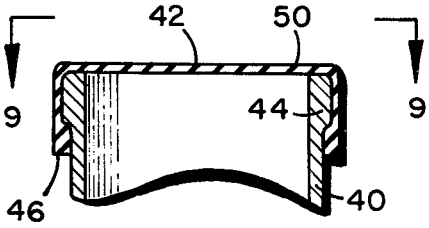
FIG. 8 shows the novel cap of this invention as seen in a sectional view through a fragmented container having the cap attached thereto.

At the distal end from the handle portion or gripping portion 12, a major or outer ring 20 is shown. The ring 20 is attached to the cylindrical handle portion 10. The ring 20 has a second or smaller interior ring 22 interiorly thereof. The interior ring 22 is connected to the interior portion of the outer ring 20 by means of a brace or stem 24. The brace or stem 24 as can be seen in FIG. 5 is relatively streamlined and eliptical in shape.

The two rings 20 and 22 are fundamentally in concentric relationship, so that the axis established for both rings is the same. However, minor tolerances of the foregoing concentric relationship can be permitted so long as they do not stress the surface tension of the bubbles to be blown beyond the limitation of the viscosity of the bubble blowing solution.

With reference to the viscosity of the bubble blowing solution, the standard bubble blowing solution is usually comprised of soap, glycerine and water, which is preferably soft. The foregoing allows for a continuous well formed surface to the bubbles that are blown in a manner to maintain a high degree of surface tension both before and after bubbles are blown. Although the surface tensions can vary, depending upon the viscosity of the material and other characteristics, nevertheless, it is believed that within the general framework of bubble blowing solutions as they exist, this wand provides optimum utilization of such solutions.

Looking more particularly at the relationship of the rings 20 and 22, it can be seen that they are in a substantially planar relationship. This planar relationship allows the rings to provide a bubble within a bubble without substantial disturbance thereof on a consistent basis.

The diameter of the outside ring 20 compared to the inside ring 22 is substantially within a range of three to one. Although a three to one ratio does not have to be absolutely maintained, the inventors have found that this ratio is helpful in most frequently creating the desired bubbles (i.e., a bubble or bubbles in a bubble).

Figure 3:
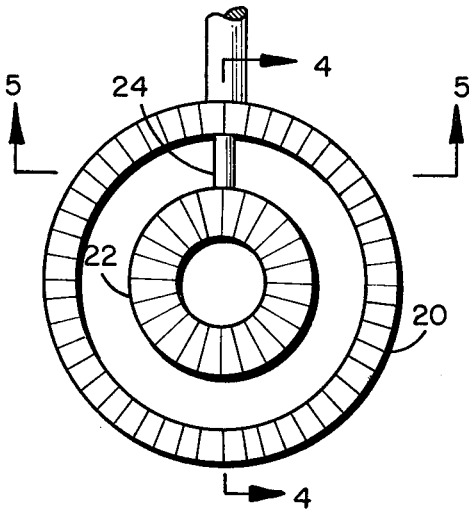
FIG. 3 shows a detailed view of the concentric rings of the bubble blowing wand of this invention.

In addition to the foregoing dimensions, the thickness of the walls of the two respective rings 20 and 22, as seen in the plan view of FIG. 2 and the detail of FIG. 3, is approximately one wherein the wall width or thickness of the inner concentric ring is approximately one and one half times the wall thickness of the outer concentric ring.

Figure 7:
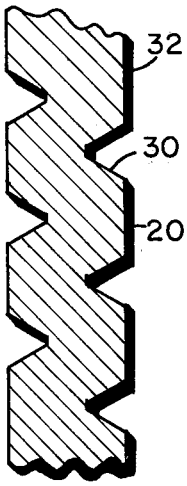
FIG. 7 shows a sectional view of the relieved surface of the rings as seen along lines 7—7 of FIG. 6.
Figure 6:
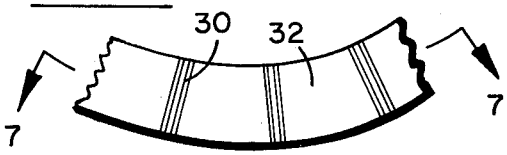
FIG. 6 shows a detailed fragmented plan view of the outer ring of the wand as enscribed by circle 6 of FIG. 2.

The foregoing concentric rings are provided with a relieved surface as can be seen in greater detail in FIGS. 3, 6 and 7. These relieved surfaces can be cuts, notches, or any kind of conformation that increases the overall surface area of the ring. FIGS. 6 and 7 show grooves 30 and lands 32 that have been formed in the faces of the rings 20 and 22. The lands and grooves 32 and 30 respectively allow for a greater loading of the bubble blowing solution on the face thereof, thereby allowing more material to be deposited and eventually made into a bubble. This helps to prevent overdrawing of the surface tension and popping of the bubble that has often been encountered within the prior art. This also allows the bubble making process to occur more frequently.

It should be understood that any particular cuts, grooves, increased heights and deviations in cross section and general overall relief of the surface of the rings 20 and 22 is desired. The prior art has generally drawn the conclusion that smooth surfaces should be provided. As a consequence, this invention should be understood to encompass the general conformation of all rings for bubble blowing purposes having generally relieved surfaces that are not necessarily smooth.

In reference to the two respective concentric rings or circles 20 and 22, it should be understood that the inventors have found in some cases geometric configurations such as squares, rectangles, triangles, and other members can be imposed in substantially concentric relationship to provide a bubble within a bubble. The general intent is that the two respective geometric members substituted for the rings reside in substantially the same plane and at the same time have relieved surfaces. In other words, two geometric shapes providing concentric peripheral surfaces concentrically spaced in the same plane will function generally in the manner prescribed.

Figure 12:
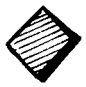
FIG. 12 shows an alternative view of a section of the wand brace or stem as an alternative to that shown in FIG. 5; and, FIG. 13 shows a second alternative brace or stem as a replacement for that shown in FIG. 5.
Figure 13:
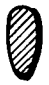

Looking more particularly at FIGS. 5, 12 and 13, it is seen that a streamlined stem 24 is shown. In FIG. 5, it has a generally eliptical configuration. The showing of FIG. 12 shows a streamlined leading and trailing surface, having pointed ends in the form of a parallelogram, while FIG. 13 shows a generally teardrop configuration. The general requirement of the foregoing stem 24 that interconnects the inner ring 22 to the outer ring 20, is that it should be as thin as possible and of a generally streamlined configuration. It has been found that the streamlined configuration prevents the turbulence and tearing of the bubble blowing solution, thereby creating superior bubbles within a bubble.

The foregoing features of the relieved surfaces and the generally planar relationship of the two rings that are to provide the bubble blowing functions, serve to enhance the operation of the invention and should generally be combined with each other. However, each serves to enhance the operation of the other, while at the same time being independent in function and application singularly or in combination.

Looking more particularly at FIGS. 8, 9, 10 and 11, a jar or container 40 in cross section is shown. The jar 40 has a cap 42 connected to a lip 44, thereof, the lip 44 is an expanded portion of the jar's sidewall and receives a flanged ridge 46 around the edge thereof.

Figure 9:
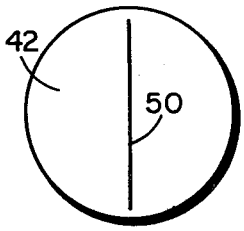
FIG. 9 shows a plan view of the cap as seen in the direction of lines 9—9 of FIG. 8.

The lid 42 is generally formed of an elastomeric material or elastic that maintains its memory. The top of the lid 42 has a slit 50 therein as seen in FIG. 9 of a substantially elongated diametric relationship.

Figure 10:
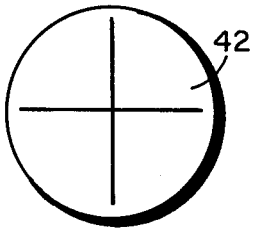
FIG. 10 shows a plan view of an alternative slit configuration of a cap.
Figure 11:
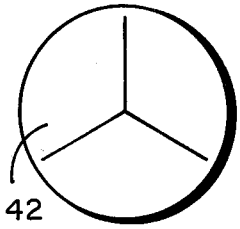
FIG. 11 shows a second alternative plan view of the cap.

Other slits having a cross shaped configuration such as in FIG. 10, or a three part radial configuration, as seen in FIG. 11, can also be utilized. It is the general intent of the foregoing configurations to provide a lid 42 wherein the wand can be implaced within the solution filling the jar 40 by separating or spreading the slit 50 or those other alternative slits shown in FIGS. 10 and 11. Upon spreading of the slit 50 or slits, the wand 10 can be withdrawn without substantially wiping the solution from the wand 10, inasmuch as much of the relieved surface of the wand has the solution thereon. As an alternative, the liquids in the container can be shaken therefrom, such as cleaning agents onto a rag.

In addition thereto, the main feature of the top is one wherein substantial spilling of the liquid is precluded. In other words, when the jar 40 is tipped over, the fluid will not immediately flow therefrom, but will merely drip therefrom so long as the jar is in the overturned position. As is well known, children will have a tendency, as well as adults, in any kind of open container configuration to spill materials when a jar or bottle is knocked over. This particular invention is designed to overcome the foregoing deficiencies by preventing such spilling.

As can be seen from the foregoing description of the preferred embodiments, the wand or bubble blowing toy can be formed of any type of material such as metal, plastic or hardened rubber, so long as it has the general configuration and features as previously described. It can be made by an injection molding process. It can also be made from any type of plastic so long as the memory of the plastic retains the general physical configuration as previously described.

As a consequence, this invention is to be read broadly with regard to the relationship of the concentric rings, their relieved surfaces, as well as the stem or member supporting the rings in their concentric relationship as defined and claimed hereinafter. Furthermore, the lid configuration should be understood to teach a non-spill type of lid, that although not necessarily being drip proof, is substantially spill proof.

We claim:

1. A bubble blowing wand for purposes of blowing a bubble or bubbles within a bubble comprising:

a handle;

a first member defining a peripheral surface attached to said handle;

a second member defining a like peripheral surface area spaced interiorly of said first member substantially in the same plane therewith and connected thereto by a stem wherein said space between said first and second members extends between them respectively except where said stem connects them; and, a relieved surface on both of said peripheral surfaces defining members for providing bubble blowing fluid on the surfaces thereof.

2. The bubble blowing wand as claimed in claim 1 further comprising:

a stem between said first and second peripheral members having a substantially streamlined cross sectional configuration.

3. The bubble blowing wand as claimed in claim 1 wherein:

said peripheral members are in substantially concentric relationship.

4. The bubble blowing wand as claimed in claim 4 wherein:

said peripheral members are two concentric rings,

5. The combination of the foregoing bubble blowing wand of claim 5 and a container having a lid wherein said lid comprises:

a flexible member having a slit with sufficient elasticity and memory therein to allow the passage of said concentric rings into the slit and the removal therefrom, while at the same time allowing the slit to close upon itself substantially to prevent the spilling of fluid therefrom.

6. A bubble blowing wand comprising:

a wand or handle member;

a first outer ring attached to said handle member;

a second inner ring attached to a stem interiorly connected to said first ring; and wherein, the surfaces of said two respective concentric rings have lands and grooves around the periphery of said rings allowing for greater surface loading of bubble blowing liquid thereon.

7. The bubble blowing wand as claimed in claim 6 wherein:

said relieved surface is provided by slots within the surfaces of said concentric rings.

8. The bubble blowing wand as claimed in claim 7 wherein:

the diameter of said outer ring is substantially within the range with respect to the diameter of said inner ring in a ratio of three to one.

9. The bubble blowing wand as claimed in claim 8 wherein:

the thickness of the wall of the inner concentric ring is approximately one and one half times the thickness of the wall of the outer concentric ring.

10. The bubble blowing wand as claimed in claim 6 wherein:

said stem between said inner and outer rings is formed of a substantially bilaterally symmetrical stem in cross section having a tapered surface at either outer end.

* * * * *